United States Patent [19]

Hadtke

[11] 4,027,340

[45] June 7, 1977

[54] FACE MASK

[75] Inventor: Frederick B. Hadtke, New Providence, N.J.

[73] Assignee: Robert Hain Associates, Inc., Scotch Plains, N.J.

[22] Filed: Mar. 15, 1976

[21] Appl. No.: 667,267

[52] U.S. Cl. ..... 2/206; 46/1 L

[51] Int. Cl.[2] ..... A42B 1/00

[58] Field of Search ..... 2/206, 9, 173; 46/1 L; 93/84 R

[56] References Cited

UNITED STATES PATENTS

| | | | |
|---|---|---|---|
| 885,802 | 4/1908 | Sterrick | 2/206 |
| 2,364,354 | 12/1944 | Felch | 2/206 |
| 2,795,796 | 6/1957 | Ray | 2/206 |
| 3,788,934 | 1/1974 | Coppa | 46/1 L UX |

*Primary Examiner*—Werner H. Schroeder
*Assistant Examiner*—Peter Nerbun
*Attorney, Agent, or Firm*—Alexander T. Kardos

[57] ABSTRACT

A face mask blank, with or without an attached head covering, comprising: lines scored, cut, or impressed into the surface of flat, flexible sheet material, outlining thereon at least two or more concentric geometric figures, such as circles or polygons including squares, pentagons, hexagons, etc., of similar shape and outline but of dissimilar area and size; and a slit cut into the flat, flexible sheet material to the center of the concentric geometric figures, permitting a portion of the geometric figures to be angularly rotated to overlap another portion of the geometric figures, whereby the flat flexible face mask blank is transformed into a three-dimensional configuration having very unusual three-dimensional eye contours, or other three-dimensional human or animal facial or body features, such as a three-dimensional nose, or eyebrows, ears, devils horns, rams or goat horns, rhinocerous horns, elephant tusks, walrus tusks, fangs, etc. Means may also be provided to cover additional portions of the face and head, or even the body, or to hold the three-dimensional face mask in position during use.

17 Claims, 14 Drawing Figures

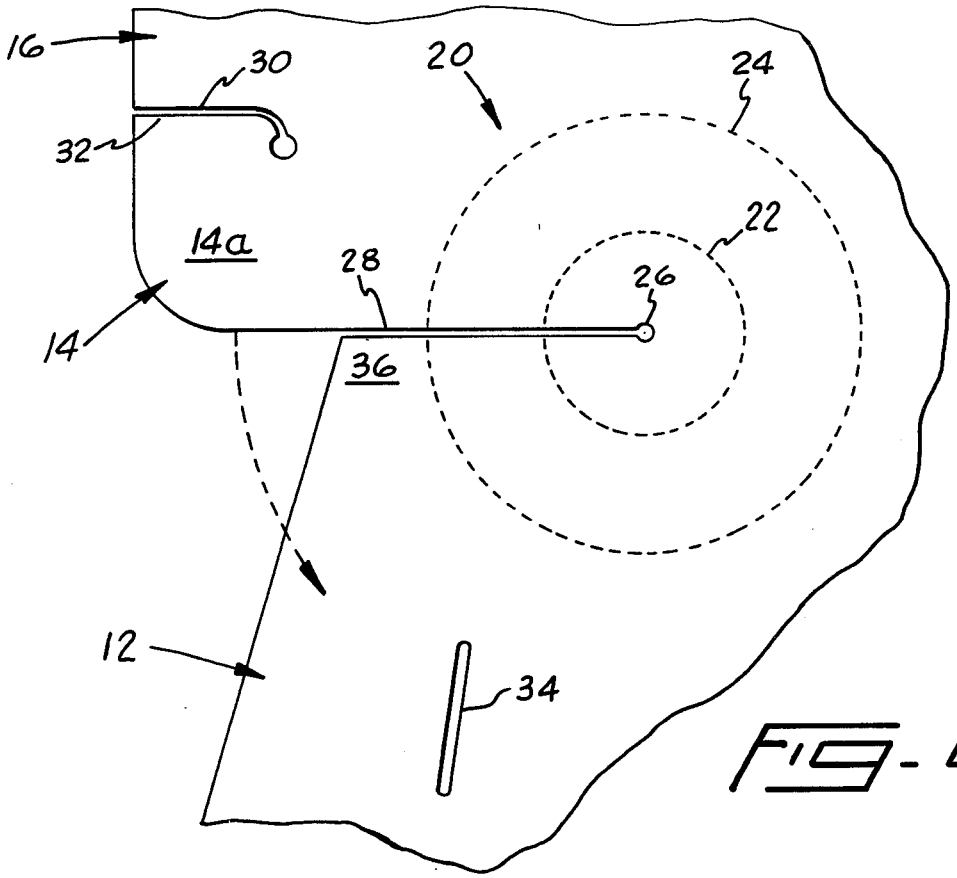
FIG. 2
FIG. 2a
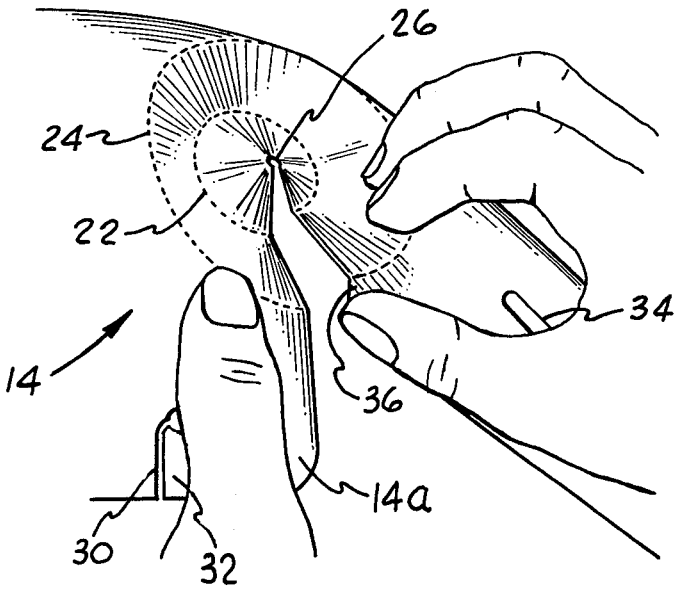

FIG. 2b
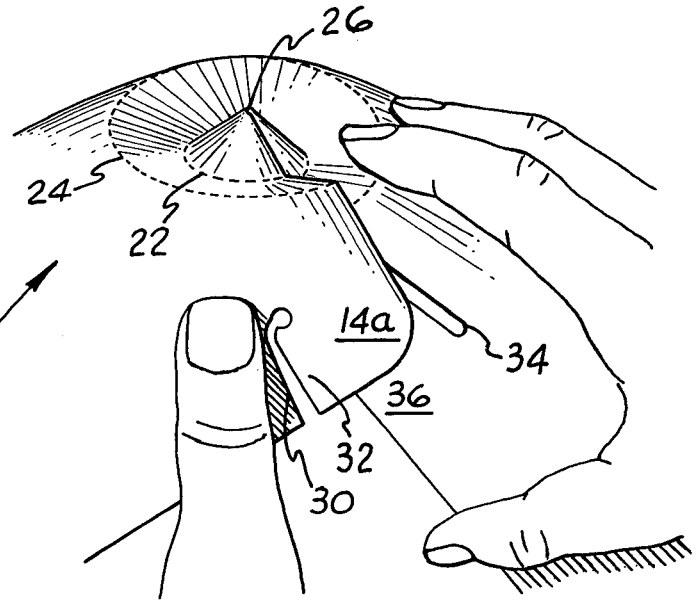
FIG. 2c
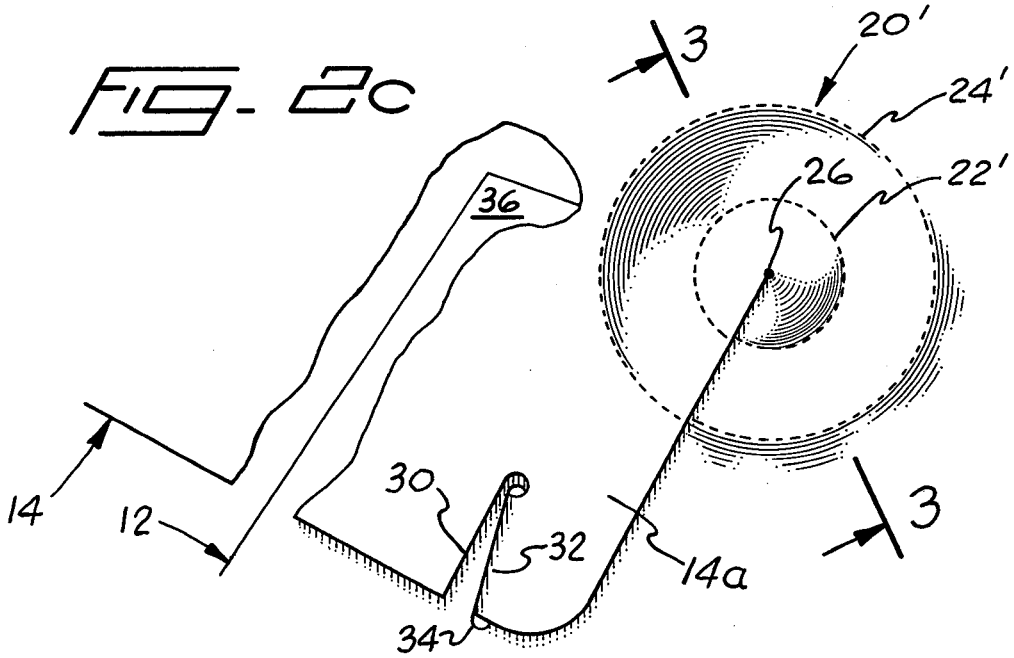
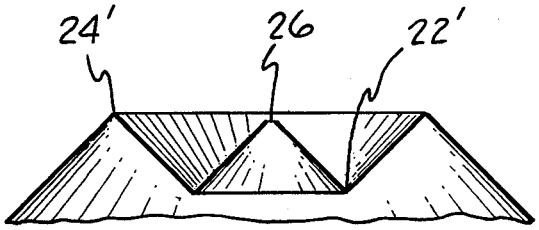
FIG. 3

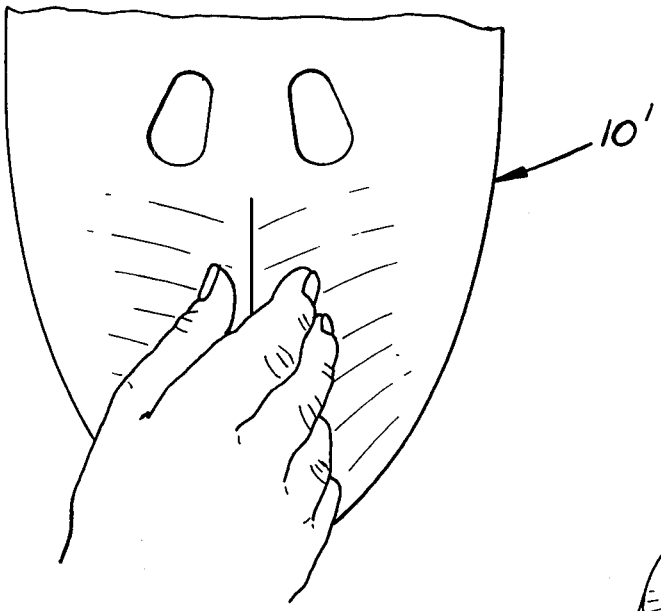
FIG. 4
FIG. 6
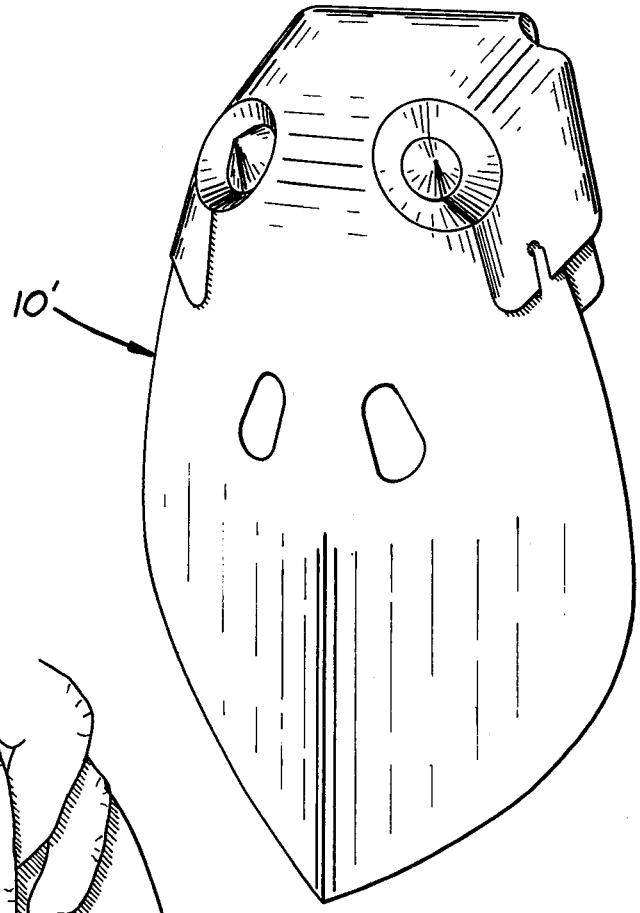
FIG. 5
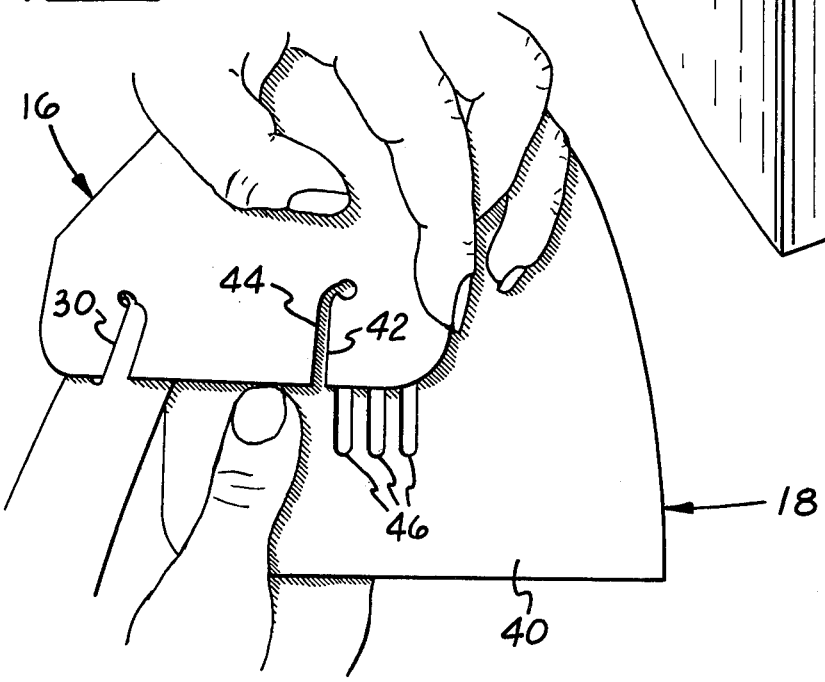

FIG. 7
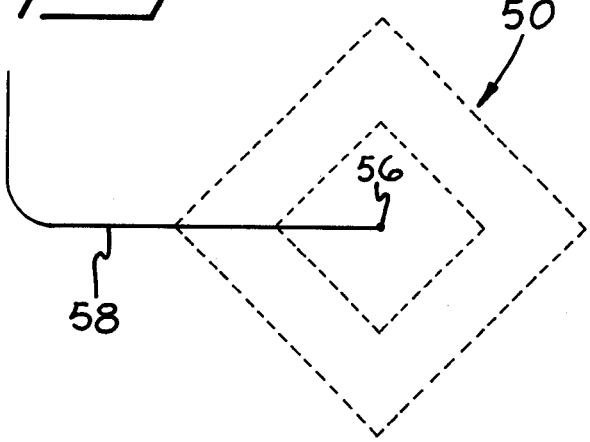
FIG. 7a
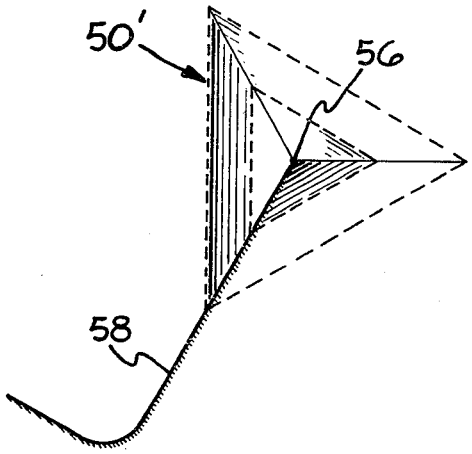
FIG. 8
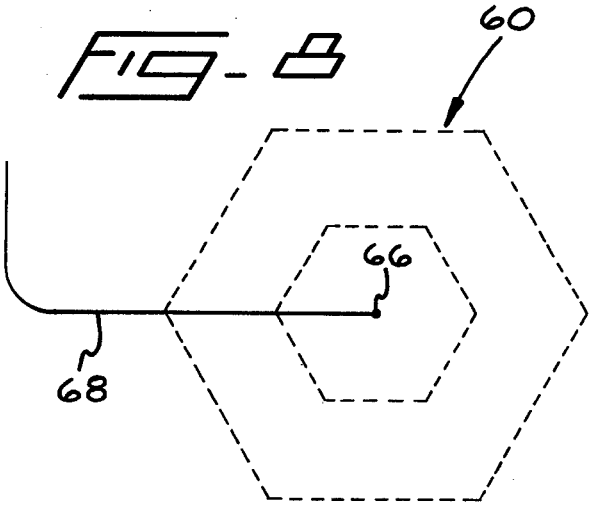
FIG. 8a
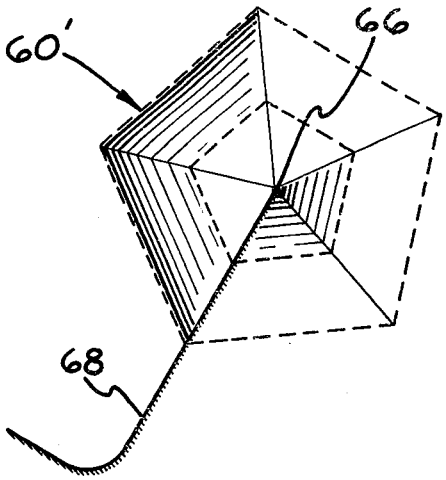
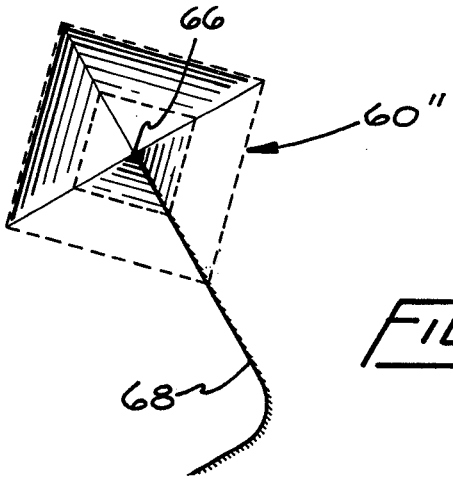
FIG. 8b

FACE MASK

FIELD OF THE INVENTION

The present invention concept relates to face masks which have been designed to cover as little as only a portion of the face of the wearer, such as only the eyes, or to cover up to as much as the entire face and head of the wearer, or even his body, and which are used in masquerades, Mardi Gras, festivals, carnivals, Halloween "trick or treaters", parties, etc. More specifically, the present inventive concept relates to such face masks, with or without head coverings, which are available as blanks of flat, flexible, planar sheet materials, capable of conversion easily and quickly into three-dimensional configurations having unusual three-dimensional animal or human eye or other facial or body features and contours.

BACKGROUND OF THE INVENTION

Face masks have been used for centuries for masquerades, Mardi Gras, festivals, carnivals, parties, and the like, and have taken many shapes and forms. Some of them are very small and cover only the eyes of the wearer; others are very large and cover the face and head of the wearer, and sometimes the complete body. Some of them are very unusual and have very unique three-dimensional features and characteristics and it has always been the purpose and object of those who make such masks to make them more unique and unusual and have more novel three-dimensional, life-like features and characteristics. Another purpose and object of those who make such masks has been to provide a flat, two-dimensional sheet material blank which can easily and economically be made, stored, shipped, handled, etc., and then easily and quickly be transformed into a face mask having unusual three-dimensional, life-like features and characteristics.

A purpose and object, therefore, of those who make such masks has been to make them possess more novel, three-dimensional life-like features and characteristics. However, in developing such life-like features and characteristics, they have developed forms which are irregular in shape and have been permanently formed from two-dimensional sheet materials. Unfortunately, such irregularly-shaped masks then required more space for purposes of shipping, storing, and retailing.

PURPOSES AND OBJECTS OF THE INVENTION

The principal purposes and objects of the present inventive concept are therefore to create face mask blanks which are flexible, flat, planar, two-dimensional sheet materials which can easily and economically be manufactured, stored, shipped, handled, retailed, etc., and which can subsequently be easily, simply, and quickly transformed or converted into face masks having very unique and unusual three-dimensional features and characteristics, and then, if so desired or required, transformed or converted back to the original, flat two-dimensional sheet material form.

BRIEF SUMMARY OF THE INVENTION

It has been found that such principal purposes and objects, as well as other principal purposes and objects which will become clear from a further reading and understanding of this disclosure, may be achieved by forming a face mask blank of flat, flexible sheet material comprisng: lines scored or cut into the surface of a flat, flexible sheet material outlining thereon at least two or more concentric geometric figures, such as circles, or polygons including squares, diamonds, pentagons, hexagons, heptagons, octagons, etc., of similar shape and outline but of dissimilar size and area; and a slit cut into the flat, flexible sheet material to the center of the concentric geometric figures, permitting a portion of the geometric figures to be angularly rotated so as to overlap a portion of another geometric figure, whereby the flat, flexible face mask blank is transformed into a three-dimensional configuration having unusual and unique animal or human eye or other facial or body three-dimensional features and characteristics which are life-like and realistic.

Although the present invention will be described in greater detail with particular regard to the formation of a three-dimensional eye as the preferred embodiment, it is to be appreciated that other animal or human facial or body features and aspects are also applicable within the broader aspects of the invention. For example, the nose and eyebrows portion can be similarly made, as well as the chin or ear portions, and even devils horns, or rams, goats, or rhinocerous horns, or elephant or walrus tusks, fangs, or other projecting or protruding members.

BRIEF DESCRIPTION OF THE DRAWINGS

In the following specification and accompanying self-explanatory drawings, there are described and illustrated preferred embodiments of the present invention, but it is to be understood that the invention, in its broader aspects, is not to be construed as limited to such preferred embodiments, as disclosed, except as determined by the scope of the appended claims.

Referring to the accompanying drawings,

FIG. 2 is a simplified, schematic or diagrammatic plan view of a portion of the typical face mask blank of FIG. 1, but drawn to a larger scale and showing in greater detail the two-dimensional construction of the face mask of the present invention;

FIG. 2*a* is a fragmentary perspective view of a portion of the typical face mask blank of FIG. 1, showing the face mask blank at a later time in the formation of its three-dimensional eye features and characteristics;

FIG. 2*b* is a fragmentary perspective view of a portion of the typical face mask blank of FIG. 1, showing the face mask blank at a still later time in the formation of its three-dimensional eye features and characteristics;

FIG. 2*c* is a simplified, schematic or diagrammatic plan view of a portion of the typical face mask blank of FIG. 1, very similar in nature to the plan view of FIG. 2, but showing the completely formed three-dimensional eye;

FIG. 3 is a fragmentary cross-sectional view, taken on the line 3—3 of FIG. 2*c*, showing the three-dimensional contours of the eye-ball and eye-socket of the face mask;

FIG. 4 is a fragmentary perspective view, showing the formation of the lower front portion of the completed three-dimensional face mask;

FIG. 5 is a fragmentary perspective view of the rear portion of the typical face mask blank of FIG. 1, showing the formation of the head covering and size adjustment therefor;

FIG. 6 is a perspective view, showing the typical face mask blank of FIG. 1 in its completed three-dimensional configuration;

FIGS. 7 and 7*a* are simplified, schematic or diagrammatic plan views, similar in concept of FIGS. 2 and 2*c*, showing a modification of the face mask of the present invention; and FIGS. 8, 8*a* and 8*b* are simplified, schematic or diagrammatic plane views, similar in concept to FIGS. 2 and 2*c*, as well as FIGS. 7 and 7*a*, showing another modification of the present invention.

DESCRIPTION OF THE PREFERRED EMBODIMENT OF THE INVENTION

The Flat, Flexible Face Mask Blank

Figure 1:
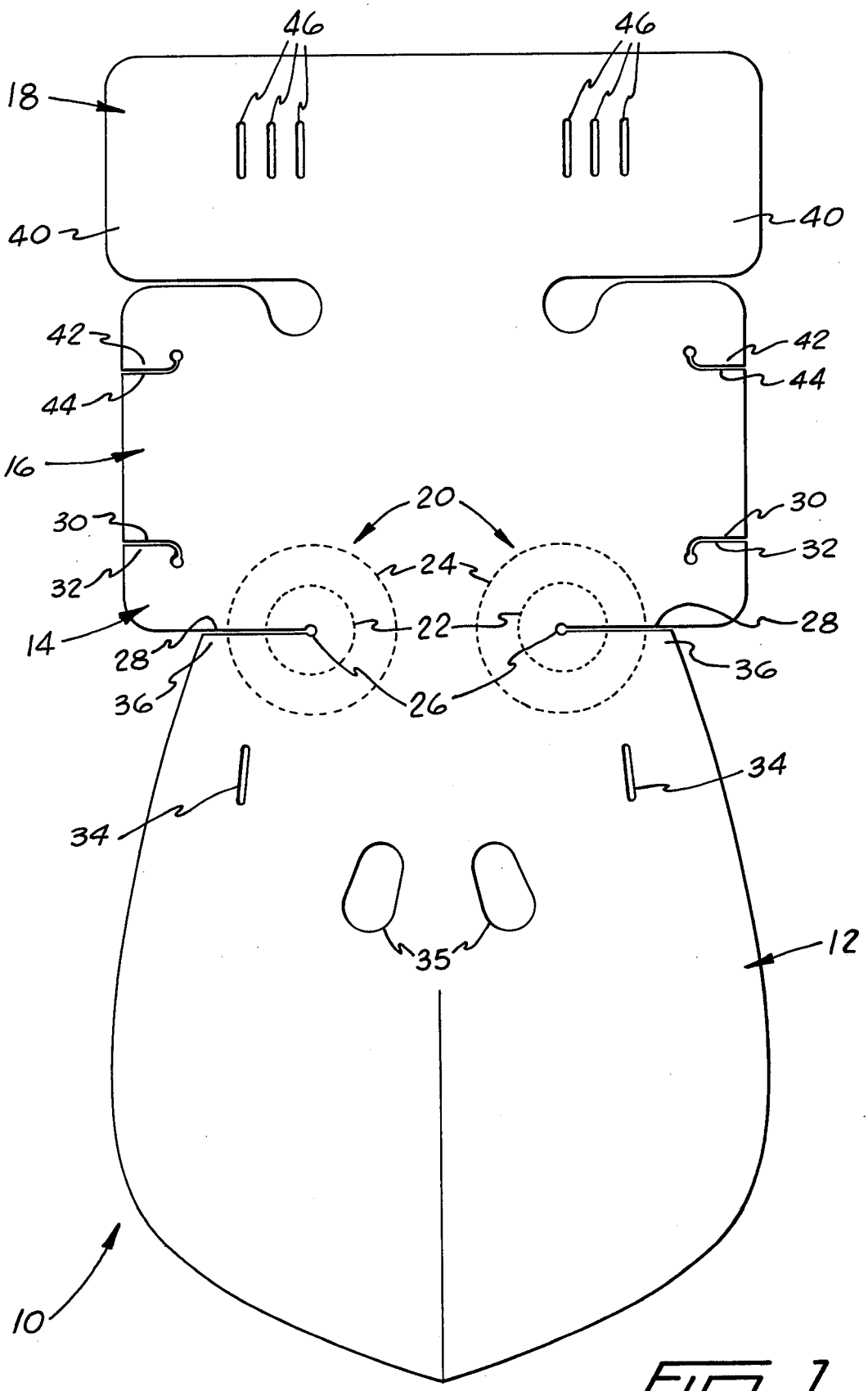
FIG. 1 is a simplified, schematic or diagrammatic plan view of a typical face mask blank of flat, flexible sheet material, suitable for the application of the principles of the present invention.

With reference to FIG. 1 of the drawings, there is shown a face mask and head covering blank 10 formed, such as by a conventional stamping operation, from a flat, slightly stiff but flexible and arcuately foldable sheet material, such as cardboard, pasteboard, paperboard, fiberboard, linerboard, chipboard, plastic sheet material, paper or a paper product, or other suitable sheet material having some degree of stiffness and rigidity, but being capable of being flexed and bent into various arcuate degrees of curvature. Sheet material of the quality of a typical playing card, or a calling card, or slightly lighter or heavier, is very suitable.

The average thickness of such suitable sheet materials is normally in the range of from about 0.008 inch to about 0.050 inch, and preferably in the range of from about 0.012 inch to about 0.024 inch.

The face mask and head covering blank 10 comprises; a face portion 12, the upper part of which will be more specifically referred to hereinafter as an eye portion 14; a top portion 16 immediately above and adjacent to the eye portion 14; and a back portion 18 which is immediately above and adjacent to the top portion 16. As shown in FIG. 1, the face portion 12, the eye portion 14, the top portion 16, and the back portion 18 are cut or stamped out of one piece of sheet material and are integral.

The Eye Portion

The eye portion 14 comprises what may be loosely described as a pair of circular human or animal-like eyes 20, 20 formed by a pair of concentric circles 22, 22 and 24, 24 having points 26, 26 as their common centers. The inner and smaller concentric circles 22, 22 may be likened generally to an eye-ball, whereas the outer and larger concentric circles 24, 24 may be likened generally to and eye-socket. As shown, the smaller concentric circle 22 has a radius about half that of the larger concentric circle but such proportion may be varied, as desired.

The concentric circles 22, 22 and 24, 24 are formed by lines which are impressed, scored, or cut into the surface of the flat, flexible sheet material. These scored or cut lines delineate or outline on the flat, flexible sheet material concentric geometric figures of similar shape and form, that is, in this particular case, they are both circles, but of dissimilar size and area, that is, in this particular case, the circles have different radii and different peripheries or circumferences. Similarly, if the geometric figures were squares, then both are equilateral and equiangular polygons, although having different length sides and, of course, different areas and peripheries.

The cuts or scores do not go all the way through the sheet material merely a small fraction of the total thickness need be cut or scored. The cut lines may be continuous cuts or scores, or they may be discontinuous and penetrate all the way through, like a dotted, dashed, or perforated line. Naturally such scoring or cutting into the surface of the sheet material slightly weakens the sheet material along such scored or cut lines and they are less likely or able to resist stresses applied to the sheet material. The purpose and function of such cuts and scores will become clearer from a further reading and understanding of this disclosure.

Extending laterally outwardly from the common centers 26, 26 of the concentric circles 22, 22 and 24, 24 in the eye portion 14 are relatively narrow slits 28, 28 which extend generally horizontally like radii from the common centers 26, 26 of the concentric circles 22, 22 and 24, 24 to the outer edges of the eye portion 14 of the face portion 12 of the face mask blank 10. Directly above the relatively narrow slits 28, 28, the eye portion 14 widens and, in conjunction with another pair of relatively narrow slits 30, 30, there is formed a pair of locking tabs 32, 32 which perform a locking and holding function to be described more fully hereinafter.

THE FORMATION OF THE THREE-DIMENSIONAL EYE

With more specific reference to FIGS. 2–2*c*, it is to be noted that an upper and outer portion 14*a* adjacent the left hand side of eye portion 14 is adapted to be angularly rotated downwardly and inwardly (see FIGS. 2 and 2*b*) to overlap a corner portion of the underlying lower and inner section of the eye portion 14.

During such angular rotation, the center point 26 of the concentric circles on the left side remains relatively stationary, whereas the effective lengths of the peripheries or circumferences of the original circular areas become shortened. This is due to the fact that the peripheries or circumferences are gradually overlapping each other whereby their total effective or real lengths are decreased.

Normally, the stresses and the strains produced by such an angular rotational movement would tend to transform the flat, circular areas into three-dimensional conical figures with the center point 26 becoming the top or peak of the cone; with the radii of the larger concentric circle 24 becoming the slant heights of the cone; and with the periphery or circumference of the larger concentric circle 24 becoming the periphery of circumference of the conical figure which is developed. This is what would happen if all the portions of the circular areas were substantially uniform in their strengths.

However, during such angular rotation and the concomitant stresses and strains produced therein, the lines were scored or cut into the surface of the sheet material in the eye portion 14 create areas which more readily yield to such applied stresses or forces, whereby the inner and smaller circular area can be directed outwardly in one direction, while the outer and larger circular area can be directed inwardly in the other direction to create a three-dimensional eye having an eye-ball extending outwardly with bulging effect and an eye-socket extending inwardly with a cavernous effect. FIG. 3 clearly discloses the changes which are effected. The greater the degree of angular rotation, then the more pronounced and more prominent will be the three-dimensional effect which is achieved. FIG. 2*c* shows the effect of an angular rotation of about 60° but greater or lesser degrees of angular rotation are possible. A relatively narrow holding slit 34 is cut into the face portion 12 of the face mask blank 10 and is so positioned that, when the angular rotational movement is sufficient to produce the desired three-dimensional effect in the eye, the locking tab 32 is adapted to be slipped into the holding slit 34 to hold the lock the angularly totated portion 14*a* in such desired position. The end result is to be noted especially in FIG. 2*c*.

Thus far, the description of the procedures and the illustrations thereof have related to the left hand eye of the face mask blank 10. The same procedures are repeated, this time with the right hand eye, with the action having an opposite hand and direction, whereby the second eye with the desired three-dimensional effect is obtained. The end result is noted in FIGS. 4 and 6.

A pair of peep holes or apertures 35, 35 is provided, one on each side of the face portion 12 below the eye portion 14, to permit the wearer to see out of the face mask 10 and to provide better ventilation.

The center of the lower front part of the face portion 12 may then be pinched or squeezed together slightly, as shown in FIG. 4, to form a rounded contour having a better and more realistic face-like appearance.

The face mask portion is thus completed and can be used as such. However, if desired, a head covering and holding portion may be provided.

The Head Covering

The top portion 16 of the face mask blank 10 is substantially rectangular in shape and is arcuately bent backwardly so that it is in a plane approximately at right angles to the plane of the eye portion 14 or face portion 12. The back portion 18 is then arcuately bent even further backwardly so that it makes another right angle bend to end up at right angles to the plane of the top portion 16 and generally parallel to the plane of the eye portion 14 or face portion 12. The end parts 40, 40 of the back portion 18 are then arcuately curved around, as noted in FIG. 5, until locking tabs 42, 42, formed by relatively narrow slits 44, 44 reach a position immediately adjacent a series or plurality of short holding slots 46, 46, 46 to be inserted therein to form a head covering having a suitable adjustable size to fit the head of the wearer.

Thus, it is seen that the general assembly process of forming the eyes, eye-balls, and eye-sockets and the head covering with their locking tabs in the various holding slots, both in the eye portion, face portion and back portion, creates a substantially rigid, three-dimensional face mask and head covering from a two-dimensional, flat, flexible, non-rigid sheet material blank. As used herein, the term "similar" geometric figures of unequal or dissimilar size is intended to include concentric circles which, of course, are similarly shaped but have different radii whereby they have different areas and peripheries or circumferences, as well as equilateral and equiangular polygons, inside of each other, having a common center through which a straight line may be passed to divide the polygonal geometric figure into two equal areas of mirror-image symmetry.

Also, although the present invention has been described in greater particularity with specific reference to the use of two similar closed plane geometric figures of dissimilar size and area, a greater number of geometric figures may be used. For example, the use of three or four geometric figures provides some very unusual, interesting and varied effects.

And, although the present invention has been described in greater particularity with specific reference to concentric circles as the preferred geometric figures which are desirably closed and planar, it is to be realized that other geometric figures, which are not necessarily closed, are equally applicable within the broader aspects of the present invention. Specific examples of such other geometric figures and squares, diamonds, and other polygons such as pentagons, hexagons, heptagons, nonagons, decagons, and other polygons having an even greater number of sides. Naturally, polygons which are regular, that is, equilateral and equiangular, are preferred. In this respect, it is to be appreciated that a circle is often considered as a polygon with an infinite number of sides. For example, in FIGS. 7 and 7*a*, as well as FIGS. 8, 8*a* and 8*b*, there are shown additional illustrations of the application of the principles of the present invention to a four-sided polygon, such as a square or diamond 50, and to a six-sided polygon, such as a regular hexagon 60. The usual concentric common centers 56 and 66 are noted, and the relatively narrow slits 58 and 68 are to be noted in these Figures. Also of interest is the fact that the number of sides of the original regular polygon may be reduced in number. For example, the square or diamond 50 is transformed to a triangle 50′ of three sides, and the hexagon having six sides is transformed to a pentagon 60′ having five sides.

It is also to be appreciated that the reduction in the number of sides of the polygonal geometric figure need not be necessarily limited to a reduction of only one side, but can be more than one. For example, the hexagon of FIG. 8 can be sufficiently rotated additionally so that it is reduced successively to a square with an eye 60″ from the pentagon with an eye 60′. This is done by overlapping two or three sides to derive the polygons having the fewer number of sides. In this way, the height and the depth of the formation of the facial characteristics can be increased to provide greater contrast. In FIGS. 8, 8*a*, and 8*b*, the eye-ball and the eye-socket is emphasized as the pentagon is formed by the overlapping of one side and is even more emphasized as the square is formed by the overlapping of the second side.

The invention will be further illustrated by the following specific Examples. It must be understood, however, that, although these Examples may describe in particular detail some of the more specific features of the invention, they are given primarily for purposes of illustration and the invention in its broader aspects is not to be construed as limited thereto.

EXAMPLE I

The face mask blank illustrated in FIG. 1 of the drawings is used for this Example, It is made of a flat, flexible sheet of paperboard and has a thickness of about 0.016 inch. It has an overall length of about 24 inches (maximum at the center line) and a varied width which is normally about 12 inches (average). The two concentric circles on each side of the eye portion have radii of about 1½ inches and about ¾ inch. The larger circumference is a line impressed into the surface of the face mask blank; the smaller circumference is a line which is dotted and discontinuous and has perforations which go all the way through the thickness of the face mask blank.

In the formation of the three-dimensional eye, the corner of the extending part of the outer left hand side of the eye portion is pulled slightly forwardly, while the inner underlying corner adjacent the left hand side is pushed slightly rearwardly. This is done to facilitate the rotational movement. The outer extending part of the left hand side of the eye portion is then slowly and steadily angularly rotated downwardly in a counterclockwise direction with the common center of the two left hand circles as a center of rotation and gradually overlaps the inner underlying corner, as best illustrated in FIG. 2B of the drawings.

The common center of the two concentric circles as well as the surrounding area of the smaller concentric circle is then urged forwardly and outwardly during this rotational movement and protrudes in a convex, conical fashion from the surrounding annular area of the larger concentric circle. At the same time, the surrounding annular area of the larger concentric circle is urged rearwardly and inwardly and is recessed, cavernous-like, in a frustro-conical fashion around the conical, protruding inner area. These are the eye-ball and the eye-socket configurations.

The three-dimensional protruding and receding eye-ball and eye-socket grow in height and depth, respectively, as the overlapping relationship gradually increases, until the locking tab of the eye portion reaches the relatively narrow holding slot. The locking tab is inserted into the holding slot and the three-dimensional configuration is achieved and held, as illustrated in FIG. 2*c*. The eye with its protruding eye-ball and its receding eye-socket is very pronounced and prominent.

This procedure is then repeated for the formation of the right hand eye, with the movement and rotation of the overlapping action being the same but of opposite hand to the preceding procedure. The formation of the three-dimensional eye comprising a protruding eye-ball and a receding eye-socket is thus similar. The front face portion possesses an arcuate, convex configuration by this time and the lower central portion is squeezed slightly, as shown in FIG. 4, to give it a more pronounced and more prominent convex life-like curvature. The basic formation of the face mask is complete and is ready for use. However, a means for holding the face mask in the proper position during use is next to be prepared. The substantially rectangular top portion immediately above the eyes is then curved or bent arcuately backwardly until it reaches a plane generally about at right angles to the plane of the eye portion. The rearmost, substantially rectangular back portion is then given an additional curve or bend backwardly and downwardly until it reaches a plane at right angles to the plane of the top portion. In such a configuration, the locking tabs on each side of the top portion are at right angles to the holding slots on each side of the back portion but are substantially immediately adjacent to them. The locking taps are then curved around and are inserted into the selected holding slots, in order to form a periphery which will conform to and fit the head of the wearer.

The novel and unique three-dimensional effect of the resulting face mask and head covering is excellent. The three-dimensional eye with its protruding eye-ball and its receding eye-socket provides a surprising and startling and sometimes amusing three-dimensional effect.

EXAMPLE II

The procedures of EXAMPLE I are followed substantially as stated therein with the exception that the two concentric circles are replaced by a pair of concentric equilateral and equiangular diamonds, as illustrated in FIG. 7. The diameters of the diamonds are 3 inches and 1 inches, respectively. The results of these procedures are generally similar in principle to the results previously obtained in EXAMPLE I, and the final results and formation of the three-dimensional eye with a triangular pyramidal eye-ball which protrudes and a triangular pyramidal eye-socket which recedes is well shown in FIG. 7*a*.

EXAMPLE III

The procedures set forth in Example I are followed substantially as described therein with the exception that the two concentric circles are replaced by a pair of similar concentric equilateral and equiangular hexagons of dissimilar size and area, such as is illustrated in FIG. 8. The diameters of these regular hexagons are about 3 inches and about 1 inches, respectively. The results of the procedures of this Example are generally similar in principle to the results obtained in Example I. The final results are best shown in FIGS. 8*a* and 8*b*, wherein the protruding pentagonal and square eye-balls, respectively, are noted, along with the receding pentagonal and square eye-sockets, respectively, which establish the desirable three-dimensional effects.

EXAMPLE IV

The procedures of Example I are followed substantially as set forth therein with the exception that paperboard having a thickness of only 0.012 inch is used. The results obtained are generally similar in principle to the results obtained in Example I except that the final product does not have the sturdiness and the rigidity of the final product of Example I. The final product is commercially satisfactory and acceptable.

EXAMPLE V

The procedures set forth in Example I are followed substantially as set forth therein with the exception that paperboard having a thickness of 0.020 inch is used. the results obtained are generally similar in principle to the results obtained in Example I. The final product is very sturdy and very rigid. It is commercially satisfactory and acceptable.

EXAMPLE VI the procedures of Example I are followed substantially as set forth therein with the exception that the lines delineating or outlining the two concentric circles are both impressed a short distance into the surface of the flat, flexible sheet of paperboard and do not penetrate all the way through. The results are generally similar in principle to the results of Example I. The final product is commercially satisfactory and acceptable.

EXAMPLE VII

The procedures set forth in Example I are followed substantially as described therein with the exception that the lines outlining the two concentric circles are both dotted lines, perforating the paperboard all the way through. The results are generally similar to the results of Example I. The product is commercially acceptable.

EXAMPLES VIII – XIV

The procedures set forth in Example I are followed substantially as described therein except that the two concentric circles are replaced by pairs of similar concentric equilateral and equiangular polygons of dissimilar size and area, the polygons being:

| | | | |
|---|---|---|---|
| EXAMPLE VIII | Pentagons | EXAMPLE XII | Decagons |
| EXAMPLE IX | Heptagons | EXAMPLE XIII | Undecagons |
| EXAMPLE X | Octagons | EXAMPLE XIV | Dodecagons |
| EXAMPLE XI | Nonagons | | |

The results of these procedures are generally similar in principle to the results obtained in Example I, with the angular rotations being sufficient to produce reductions in the number of sides of the polygons by one and then by two sides. The protruding eye-balls and the receding eye-sockets create a desirable and very unusual three-dimensional effect.

EXAMPLES XV – XXIII

The procedures set forth in Examples II, III, and VIII to XIV are followed substantially as described therein for all nine types of polygons used therein, except the additional lines are impressed into the surface of the paperboard, extending radii-like from the common center outwardly through the corner-points of the inner polygons to the corner-points of the outer polygons. The angular rotation brings out the pyramidal nature of the protruding eye-balls and the receding eye-sockets, such pyramidal figures being named geometrically after their bases as triangular pyramids, rectangular pyramids, pentagonal pyramids, hexagonal pyramids, etc. The triangular sides of the eye-balls and the frustro-triangular sides of the eye-sockets are to be noted especially. The three-dimensional effect is unique and striking in its appearance. In all these Examples, as well as in the preceding description of the invention, it is to be noted that the common center of the concentric geometric figures, along with a smaller of the concentric geometric figures becomes extended and protrudes outwardly from the plane of the flat, flexible sheet material, while the area of a larger of the concentric geometric figures surrounding the area of the smaller of the concentric geometric figures becomes extended and recedes inwardly from the plane of the flat, flexible sheet material, whereby the flat, planar, flexible sheet material is transformed into a three-dimensional configuration having very unusual three-dimensional facial or body characteristic contours.

It is also to be realized that the slit extending from the edge of the flexible sheet material to the common center of the concentric geometric figures may be widened into a pie-shaped wedge or a sector of a circle, whereby the two edges of such a wedge or a sector which extend from the common center may be brought together during the angular rotation into a butting relationship and then held in that position by a staple or adhesive tape, preferably a pressure sensitive tape, to also form a three-dimensional figure. However, there is still technically an overlapping of the original area of the relatively stationary portion and hence the term of overlapping is still appropriate and applicable.

Although several preferred specific embodiments of the invention have been described and illustrated, the same should not be construed as limiting the broader aspects of the invention to the particular features described and illustrated, but to include various other equivalent features, as set forth in the scope of the appended claims.

What is claimed is:

1. A face mask blank comprising:

a flexible sheet material;

lines scored into the surface of said flexible sheet material, outlining thereon two concentric geometric figures of similar shape and outline but of dissimilar size and area in one part of said flexible sheet and two other concentric geometric figures in an adjacent part of said flexible sheet;

and a slit cut into said flexible sheet material from the edge thereof to the common center of said concentric geometric figures, permitting a portion of said concentric geometric figures to be angularly rotated with said common center as a center of rotation to overlap another portion of said concentric geometric figures, the area of a smaller of said concentric geometric figures extending as a cone painting in one direction from said flexible sheet material and the area of a larger of said concentric geometric figures surrounding the area of said smaller concentric geometric figure extending as a truncated cone pointing in the opposite direction from said flexible sheet material, whereby the flexible sheet material face mask blank is transformed into a three-dimensional configuration having three-dimensional facial characteristic contours.

2. A face mask blank as defined in claim 1, wherein said concentric geometric figures are concentric circles.

3. A face mask blank as defined in claim 1, wherein said concentric geometric figures are equilateral and equiangular polygons.

4. A face mask blank as defined in claim 1, wherein said concentric geometric figures are four-sided equilateral and equiangular polygons.

5. A face mask blank as defined in claim 1, wherein said concentric geometric figures are five-sided equilateral and equiangular polygons.

6. A face mask blank as defined in claim 1, wherein said concentric geometric figures are six-sided equilateral and equiangular polygons.

7. A face mask blank as defined in claim 1, wherein means is provided to hold said angularly rotated portion of said concentric geometric figures on its angularly rotated position overlapping said other portion of said concentric geometric figures.

8. A face mask blank as defined in claim 1, wherein head covering means is attached to and is integral with said face mask blank.

9. A face mask blank as defined in claim 8, wherein said head covering means is adjustable.

10. A face mask blank comprising:

a flexible sheet material;

lines scored or cut into the surface of said flexible sheet material outlining thereon two similarly shaped, concentric geometric figures in one part of said flexible sheet and two other concentric geometric figures in an adjacent part of said flexible sheet, said concentric geometric figures having a common center and defining larger and smaller areas and longer and shorter peripheries, respectively, said scored or cut lines being more susceptible to yielding to applied stresses than adjacent areas because of said scores or cuts;

a slit in said flexible sheet material extending outwardly from said common center to the edge of said flexible sheet material, separating said larger and smaller areas into a first relatively stationary portion and a second relatively movable portion, said second relatively movable portion being capable of angular rotation about said common center to overlap a part of said first relatively stationary portion bringing about a shortening of the effective lengths of said longer and shorter peripheries and causing stresses to be exerted on said yieldable scored or cut lines, capable of compelling said common center and said smaller area surrounding it to be extended as a cone in one direction and that part of said larger area surrounding said smaller area to be extended as a truncated cone pointing in the other direction to create a three-dimensional facial characteristic contour with one part thereof extending in one direction and another part thereof extending in the other direction; and means to hold said second relatively movable portion in its angularly rotated position overlapping a part of said first relatively stationary portion to maintain the facial characteristic contour in its three-dimensional, relatively rigid and permanent configuration.

11. A face mask blank as defined in claim 10, wherein said second relatively movable portion is capable of angular rotation of at least about 60° about said common center to overlap a part of said first relatively stationary portion.

12. A face mask blank as defined in claim 10, wherein said similarly shaped concentric geometric figures are circles.

13. A face mask blank as defined in claim 12, wherein there is a pair of said similarly shaped, concentric geometric figures in the form of circles having a common center, whereby the three-dimensional facial characteristic contour resembles a pair of eye-balls and a pair of eye-sockets.

14. A face mask blank as defined in claim 10, wherein said common center and said smaller area surrounding it from a conical surface and said larger area surrounding said smaller area forms a frustro-conical surface.

15. A face mask blank as defined in claim 14, wherein said common center is the top or peak of said conical surface.

16. A face mask blank as defined in claim 14, wherein said conical surface resembles an eye-ball and said frustro-conical surface resembles and eye-socket.

17. A face mask blank as defined in claim 10, wherein a pair of peep holes or apertures is provided in said flexible sheet material below said similarly shaped, concentric geometric figures.

* * * * *